US006796694B2

(12) United States Patent
Natsume

(10) Patent No.: US 6,796,694 B2
(45) Date of Patent: Sep. 28, 2004

(54) VEHICULAR SIGNAL LAMP

(75) Inventor: Kazunori Natsume, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 14 days.

(21) Appl. No.: 09/858,950

(22) Filed: May 17, 2001

(65) Prior Publication Data

US 2001/0043475 A1 Nov. 22, 2001

(30) Foreign Application Priority Data

May 17, 2000 (JP) ..... P.2000-145242

(51) Int. Cl.[7] ..... F21W 101/02

(52) U.S. Cl. ..... 362/514; 362/517; 362/518; 362/348; 362/346

(58) Field of Search ..... 362/518, 517, 362/516, 348, 297, 307, 341, 346, 520, 521, 522, 308, 309, 332, 339, 296, 326–329

(56) References Cited

U.S. PATENT DOCUMENTS 5,692,819 A * 12/1997 Mitsutake et al. ..... 353/31
6,070,993 A 6/2000 Natsume ..... 362/309
6,224,246 B1 * 5/2001 Natsume et al. ..... 362/518
6,280,064 B1 * 8/2001 Sato et al. ..... 362/348
6,382,822 B1 * 5/2002 Mackawa et al. ..... 362/522

FOREIGN PATENT DOCUMENTS

EP 0 678 703 A1 10/1995 ..... F21Q/1/00
IT 0678703 A1 * 10/1995 ..... 362/512

* cited by examiner

*Primary Examiner*—Sandra O'Shea
*Assistant Examiner*—Anabel Ton
(74) *Attorney, Agent, or Firm*—Sughrue Mion, PLLC

(57) ABSTRACT

A vehicular signal lamp providing a uniformly bright appearance even when the lamp is observed in a lateral direction. A reflecting surface of a reflector is composed of a plurality of reflecting elements for diffusing and reflecting in right and left directions the light from a light source bulb. A left direction maximum diffusion angle of the respective reflecting elements is set to a smaller value the nearer the reflecting element is located to the left end portion of the reflecting surface, and a right direction maximum diffusion angle R of the respective reflecting elements is set to a smaller value the nearer the reflecting element is located to the right end portion of the reflecting surface. Thereby, when the light is observed in a lateral direction by moving the viewing position from the light front direction to the right or left, the entire reflecting surface appears bright within a certain light viewing angle.

15 Claims, 15 Drawing Sheets

10
14
14a
14s
12
16
Ax
θR
αR
βR
θL
αL
βL
3 m
EcR
EcL

VEHICULAR SIGNAL LAMP

BACKGROUND OF THE INVENTION

The present invention relates to a vehicular signal lamp, particularly to the composition of a reflector surface or lens of a vehicular signal lamp.

In general, vehicular signal lamps irradiate a light beam in the forward direction of the lamp with a certain amount of extension in both right and left directions in order to allow the light signal to be recognized when the lamp is viewed not only directly from in front of the lamp but also from right and left lateral directions.

For this purpose, there is known a lamp as shown in FIG. 12A constructed to diffuse and reflect the light from a light source bulb 2, reflected as a substantially parallel light beam by a reflecting surface 4*a* of a reflector 4, in right and left directions by a plurality of lens elements 6*s* formed on a front lens 6, and also a lamp as shown in FIG. 12B constructed to diffuse and reflect the light from the light source bulb 2 in right and left directions by a plurality of reflecting elements 4*s* formed on the reflecting surface 4*a* of the reflector.

However, in the conventional vehicular signal lamp there occur problems, as described below, due to the fact that the right and left maximum diffusion angles θL and θR of the transmitted light from respective lens elements 6*s* or the reflected light from respective reflecting elements 4*s* are the same among all the lens elements 6*s* or among all the reflecting elements 4*s*.

For example, in a vehicular signal lamp as shown in FIG. 12B, suppose the light is observed in a lateral direction by moving the viewing position from the front direction gradually to the right. (As used herein, "right" and "left" refer to directions taken with respect to the light front direction, i.e., the direction of the main beam from the lamp).

As shown in FIG. 13 and FIG. 14, when the viewing position is moved somewhat from the light front direction to the right, concerning a reflecting element 4*s*(1) positioned at the right side of the reflecting surface 4*a*, at a viewing position E the viewing angle for the reflecting element 4*s*(1) (angle for looking at the reflecting element 4*s* from the viewing position) αR is smaller than the right direction maximum diffusion angle θR of the same element, and, on the other hand, concerning a reflecting element 4*s*(2) positioned at the left side of the reflecting surface 4*a*, the element viewing angle αR is larger than the right direction maximum diffusion angle θL thereof.

Thus, at the viewing position E the reflecting element 4*s*(1) on the right side appears brighter than the reflecting element 4*s*(2) on the left side because reflected light from the former element reaches the viewing position E, while the reflecting element 4*s*(2) on the left end side appears dark because there is no reflected light directed to the viewing position E. Consequently, as shown in FIG. 15, the reflecting area on the right side of the reflecting surface appears bright, but the reflecting area on the left side of the reflecting surface appears dark. In FIG. 15, black band portions Br extending in vertical stripes in the area in the vicinity of the right end portion of respective reflecting elements 4*s* correspond to the brightly appearing portions of the reflecting elements 4*s*.

Such a phenomenon occurs similarly in the case where the viewing position is moved from the front direction to the left, and also similarly for a vehicular signal lamp as shown in FIG. 12A.

The occurrence of such phenomenon, wherein the reflecting surface or lens that appears universally bright when viewed from a position directly in front of the lamp has portions that appear dark when the viewing position is moved to the right or left direction, impairs the overall appearance of the lamp, and is undesirable in respect of appearance quality in a vehicular signal lamp.

It is of course possible to make the lamp appear bright over a certain angular viewing position range by increasing the light maximum diffusion angle. However, if the maximum diffusion angle is simply increased, the light is diffused into unnecessary areas, the middle portion becomes dark, or the lamp must be undesirably increased in size.

SUMMARY OF THE INVENTION

The present invention was conceived in view of such problems, and it is an object of the invention to provide a vehicular signal lamp providing a good appearance even when the lamp is observed from a lateral direction where the viewing position is moved to the right or left from the front direction.

The invention achieves the above object by appropriately constructing the respective reflecting elements composing the reflecting surface of the reflector or the respective lens elements formed on the front lens.

In accordance with a first embodiment of the present invention a signal lamp is provided which comprises a light source bulb, a reflector for reflecting forward the light from the light source bulb, and a front lens provided at the forward side of the reflector, wherein the reflecting surface of the reflector comprises a plurality of reflecting elements for diffusing and reflecting in right and left directions the light from the light source bulb, and the front lens is transparent and is characterized in that the maximum diffusion angle in at least one of right and left directions of the reflected light from the respective reflecting elements is set to a smaller value the nearer the reflecting element is located to the end of the one side in the reflecting surface.

To make the maximum diffusion angle in at least one of the right and left directions smaller the nearer the reflecting element is located to the end of the one side of the reflecting surface, the left direction maximum diffusion angle may be set to a smaller value the nearer the reflecting element is located to the left end of the reflecting surface, the right direction maximum diffusion angle may be set to a smaller value the nearer the reflecting element is located to the right end of the reflecting surface, or the left direction maximum diffusion angle may be set to a smaller value the nearer the reflecting element is located to the left end of the reflecting surface, and the right direction maximum diffusion angle is set to a smaller value the nearer the reflecting element is located to the right end of the reflecting surface.

A second embodiment of a signal lamp of the present invention comprises a light source bulb, a reflector for reflecting forward the light from the light source bulb, and a front lens provided at the forward side of the reflector, the reflecting surface of the reflector being constructed to reflect the light from the light source bulb as a substantially parallel light beam, and a plurality of lens elements for diffusing and transmitting in right and left directions the reflected light from the reflecting surface are formed on the front lens, wherein the maximum diffusion angle in at least one of right and left directions of the transmitted light from the respective lens elements is set to a smaller value the nearer the lens element is located to the end of the one side of the front lens.

To make the maximum diffusion angle in at least one of right and left directions smaller the nearer the lens element is located to the end of the one side in the lens, the left direction maximum diffusion angle may be set to a smaller value the nearer the lens element is located to the left end of the lens, the right direction maximum diffusion angle may set to a smaller value the nearer the lens element is located to the right end of the lens, or the left direction maximum diffusion angle may be set to a smaller value the nearer the lens element is located to the left end of the lens, and the right direction maximum diffusion angle is set to a smaller value the nearer the lens element is located to the right end of the lens.

In both embodiments, the specific value of the maximum diffusion angle is not particularly limited, but it may be conveniently set to a value within a desirable angular range, for example, within a range of approximately 20 to 40 degrees with respect to the front direction.

Moreover, the arrangement of the plurality of reflecting elements and the plurality of lens elements is not particularly limited, and arrangements wherein the various elements are divided and arranged in vertical stripes or in a lattice or the like can be adopted. In addition, the various reflecting elements or lens elements may or may not have a vertical direction diffusing function, although they must necessarily have a right and left direction diffusion function.

The vehicular signal lamp according to the first embodiment of the present invention, which comprises a plurality of reflecting elements formed on the reflecting surface of the reflector for diffusing and reflecting in right and left directions the light from the light source bulb, and in which the maximum diffusion angle in at least one of right and left directions is set to a smaller value the nearer the reflecting element is to the end of the one side on the reflecting surface, provides the following operational advantages.

When the light is observed in a lateral direction by moving the viewing position from the light front direction to the right or left, the entire reflecting surface looks bright within a certain light viewing angle, rather than the bright portion of the reflecting area decreasing as the light viewing angle increases, as in the conventional lamp.

Consequently, with the signal lamp constructed in accordance with the first embodiment of the invention a good illuminating appearance is obtained even when the lamp is observed from a lateral direction, moving the viewing position to the right or left from the light front direction.

In this case, the reflecting surface can be formed without creating graduations or ridge lines by arranging concave horizontal section reflecting elements and convex horizontal section reflecting elements alternatingly in the right and left directions, thereby further improving the appearance of the lamp.

On the other hand, in the vehicular signal lamp according to the second embodiment of the invention, the reflecting surface of the reflector is formed to reflect the light from the light source bulb as a substantially parallel light beam, and a plurality of lens elements for diffusing and transmitting in right and left directions the reflected light from the reflecting surface are formed on the front lens. With this arrangement, the following operational advantages are obtained because the maximum diffusion angle in at least one of right and left directions of the transmitted light from the respective lens elements is set to a smaller value the nearer the lens element is located to the end of the one side on the lens.

When the light is observed in a lateral direction by moving the viewing position from the light front direction to the right or left, the entire reflecting surface appears bright through a certain light viewing angle, rather than the bright portions of the lens area decreasing as the light viewing angle increases, as in the conventional lamp.

Consequently, according to the second embodiment of the invention a good appearance is obtained even when the light is observed from a lateral direction, moving the viewing position to the right or left from the light front direction.

In either embodiment, the specific configuration of the plurality of reflecting elements and the plurality of lens elements are not particularly limited as mentioned above, and the following operational advantages can be obtained by arranging the reflecting or lens elements so that the reflected light from the respective reflecting elements or the transmitted light from the respective lens elements in the direction of the maximum diffusion angle substantially converge at a position 3 to 5 m forward of the lamp.

That is, in actual vehicle operating situations the vehicular signal lamp is observed by drivers of following vehicles, vehicles that the vehicle is passing, or the like from a position 3 to 5 m or so away from the lamp even in the closest case. Therefore, a phenomenon wherein the entire reflecting surface appears bright within a certain light viewing angle under actual vehicle operating conditions can be obtained by substantially converging the reflected light from the respective reflecting elements or the transmitted light from the respective lens elements in the direction of the maximum diffusion angle at a position 3 to 5 m forward of the lamp.

Many vehicular signal lamps are paired and disposed in right and left directions of the vehicle with a predetermined interval therebetween. In each embodiment the appearance of the two lamps can be harmonized when both lamps are observed while moving the viewing position in the right and left directions by setting the maximum diffusion angle toward the one side of the reflected light from the respective lens elements or the transmitted light from the respective reflecting elements to a value smaller than the vehicular signal lamp of the other side.

DESCRIPTION OF THE PREFERRED EMBODIMENTS

Preferred embodiments of the invention will be described with reference to the drawings.

A first embodiment of the invention will be described with reference to FIGS. 1 through 5.

Figure 1:
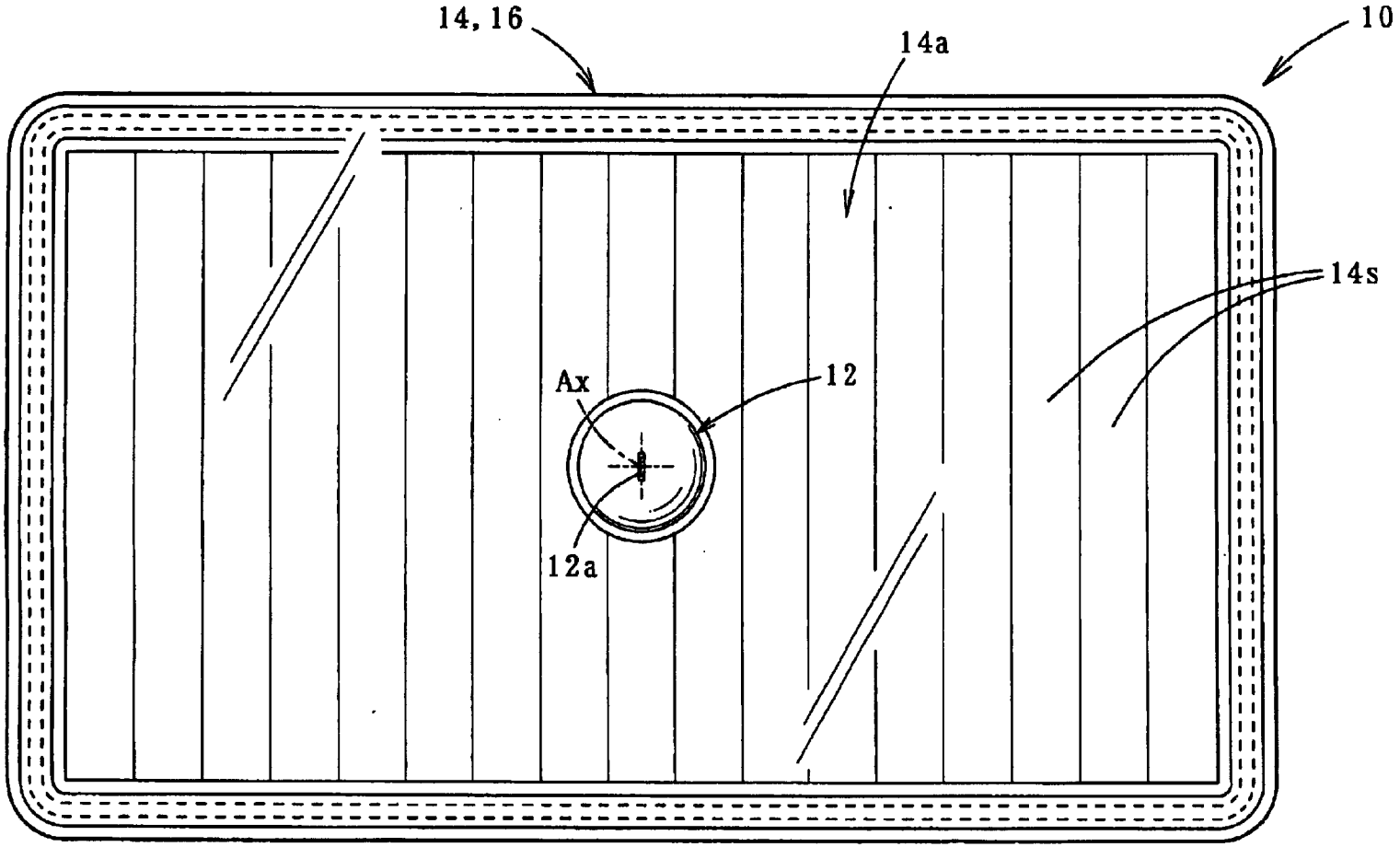
FIG. 1 is a front view showing a vehicular signal lamp constructed according to a first embodiment of the invention.
Figure 2:
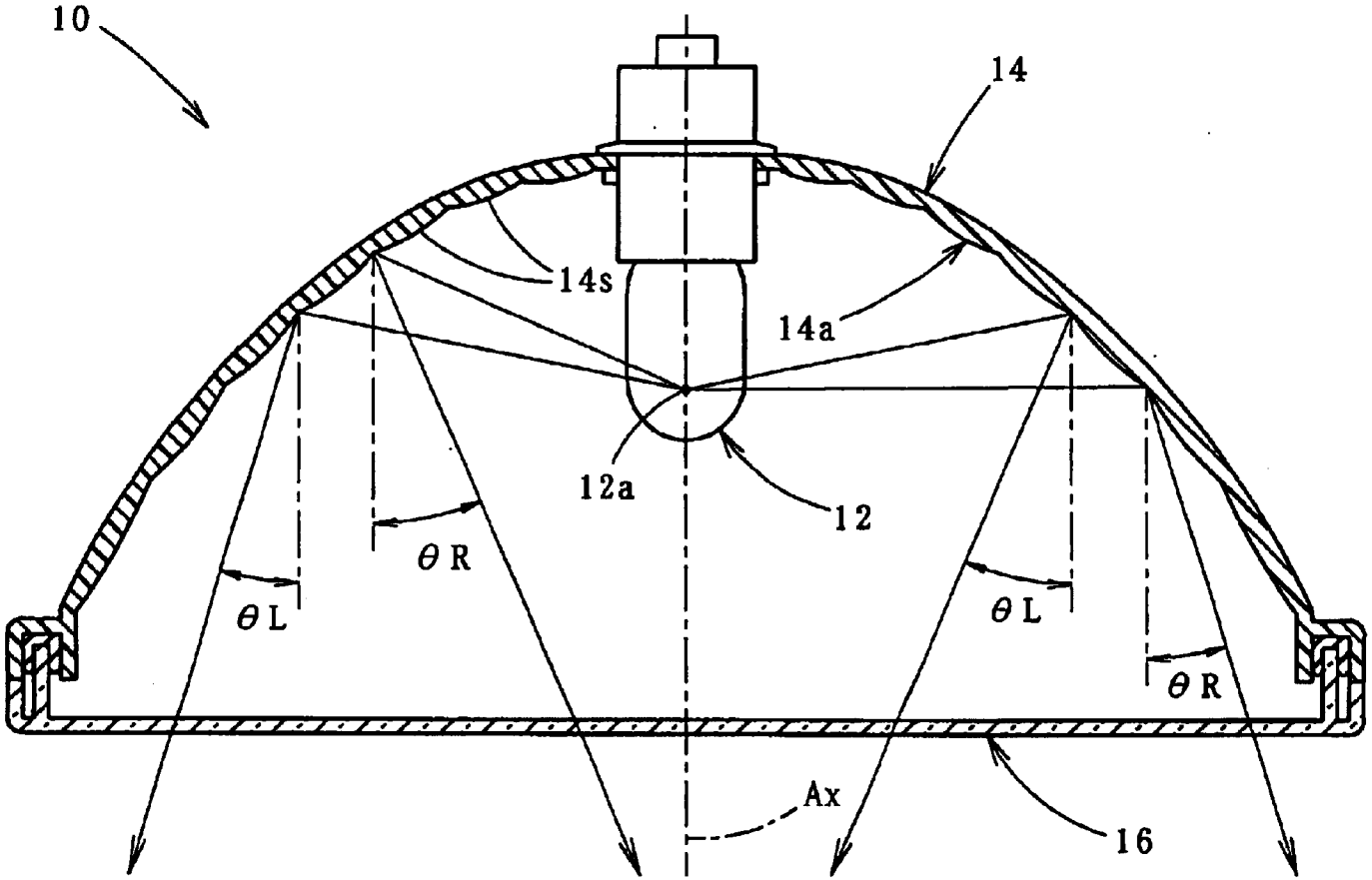
FIG. 2 is a cross-sectional view showing the vehicular signal lamp according to the first embodiment.

FIG. 1 is a front view showing a vehicular signal lamp according to the invention, and FIG. 2 shows a cross-sectional view thereof.

As shown in these drawings, a vehicular signal lamp 10 according to the first embodiment of the invention takes the form of a tail lamp intended to be mounted at the rear end portion of a vehicle (automobile). The lamp includes a light source bulb 12 having a filament 12*a* extending vertically, a reflector 14 supporting the light source bulb 12 and having a reflecting surface 14*a* for diffusing and reflecting forward (forward of the lamp, i.e., rearward of the vehicle) the light from the light source bulb 12, and a transparent front lens 16 disposed in front of attached to the reflector 14. This signal lamp 10 has a substantially rectangular outer configuration shape elongated in the right and left directions.

The reflecting surface 14*a* of the reflector 14 is composed of a plurality of reflecting elements 14*s* arranged in a vertical striped pattern. The respective reflecting elements 14*s* are defined by cylindrical reflecting elements, convex in horizontal section, formed by taking as a reference surface a parabola of rotation having as central axis the optical axis Ax of the reflector 14, extending in the forward and rearward direction of the vehicle and having as focal point the filament 12*a* position on the optical axis Ax. Consequently, the reflected light from the reflecting elements 14*s* becomes maximum in the left direction diffusion angle at the left end portion of the reflecting elements 14*s*, and the right direction diffusion angle becomes maximum at the right end portion of the reflecting elements 14*s*.

In this embodiment, the left direction maximum diffusion angle θL of the respective reflecting elements 14*s* is set to a smaller value the nearer the reflecting element is located to the left end portion of the reflecting surface 14*a*, and the right direction maximum diffusion angle θR of the respective reflecting elements 14*s* is set to a smaller value the nearer the reflecting element is located to the right end portion of the reflecting surface 14*a*.

Figures 3A, 3B:
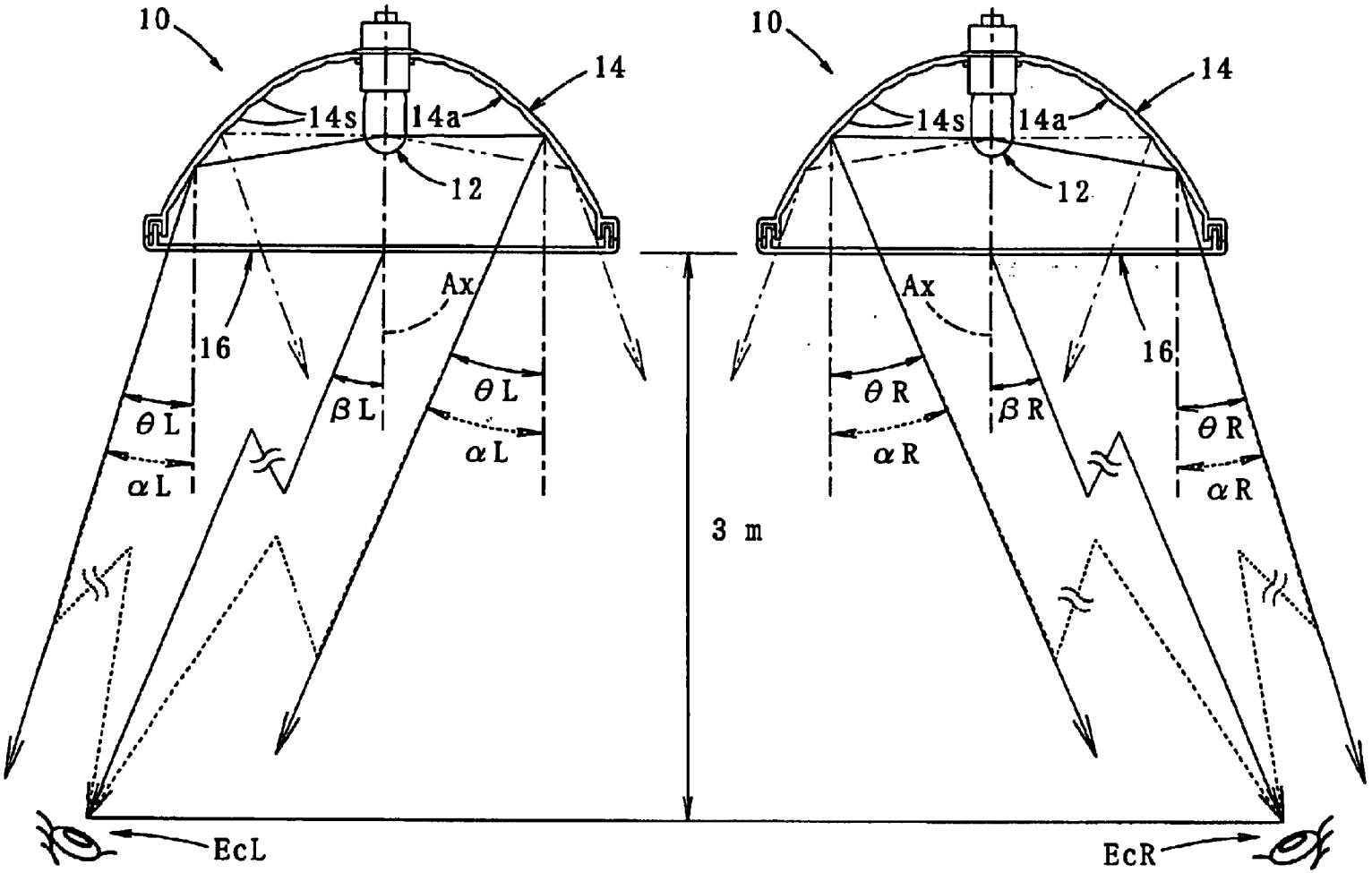
FIGS. 3A and 3B are cross-sectional views illustrating the operation of the vehicular signal lamp according to the first embodiment.

To be more specific, the horizontal tangential angle of the reflecting element 14*s* at both the right and left end portions of respective reflecting elements 14*s* is calculated so that the reflected light directed at the left direction maximum diffusion angle θL from the respective reflecting elements 14*s* converges to a left side critical viewing position EcL as shown in FIG. 3A, and the reflected light directed at the right direction maximum diffusion angle θR from the respective reflecting elements 14*s* converges to a right side critical viewing position EcR as shown in FIG. 3B. The horizontal sectional shape of the respective reflecting elements 14*s* is determined based on the results of such calculations.

The left side critical viewing position EcL and right side critical viewing position EcR are set to positions where the viewing angles (light viewing angles) βL and βR with respect to the optical axis Ax and the front lens 16 from right and left lateral directions is 30 degrees at a position 3 m in front of the lamp (i.e., 3 m behind the vehicle).

Figure 4:
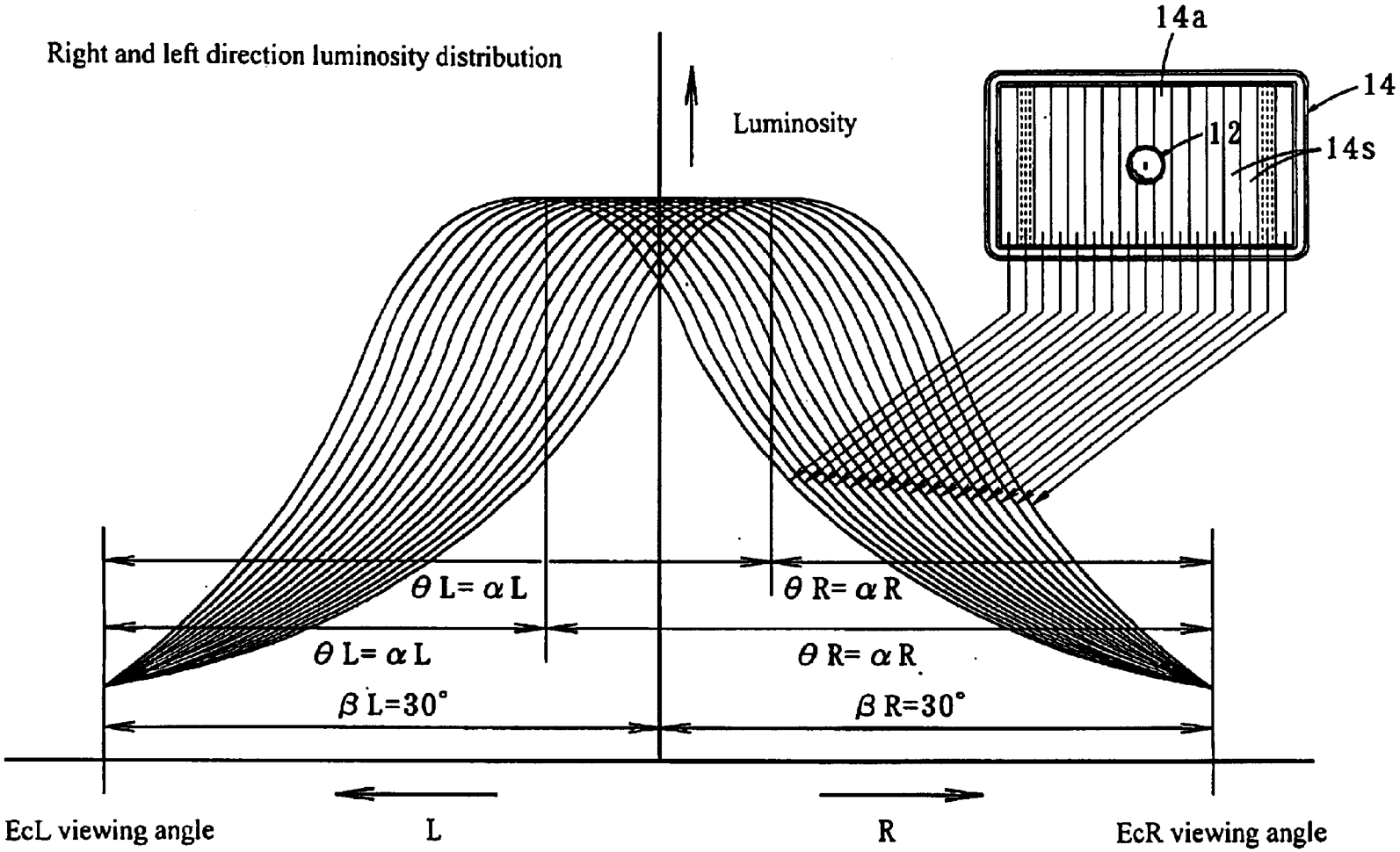
FIG. 4 is a graph showing the luminance distribution in right and left directions of the reflected light from respective reflecting elements in the vehicular signal lamp according to the first embodiment.

FIG. 4 is a graph showing the luminance distribution in the right and left directions of the reflected light from the reflecting elements 14*s*.

As shown in FIGS. 3A, 3B and 4, every left direction maximum diffusion angle θL of the reflected light from the respective reflecting elements 14*s* agrees with an element viewing angle αL of the reflecting elements 14*s*, and every right direction maximum diffusion angle θR of the reflected light from the respective reflecting elements 14*s* agrees with an element viewing angle αR of the reflecting elements 14*s*. Therefore, when the lamp is observed from a lateral direction by moving the viewing position from the light front position in right and left directions, the reflecting surface 14*a* appears as follows.

Figure 5:
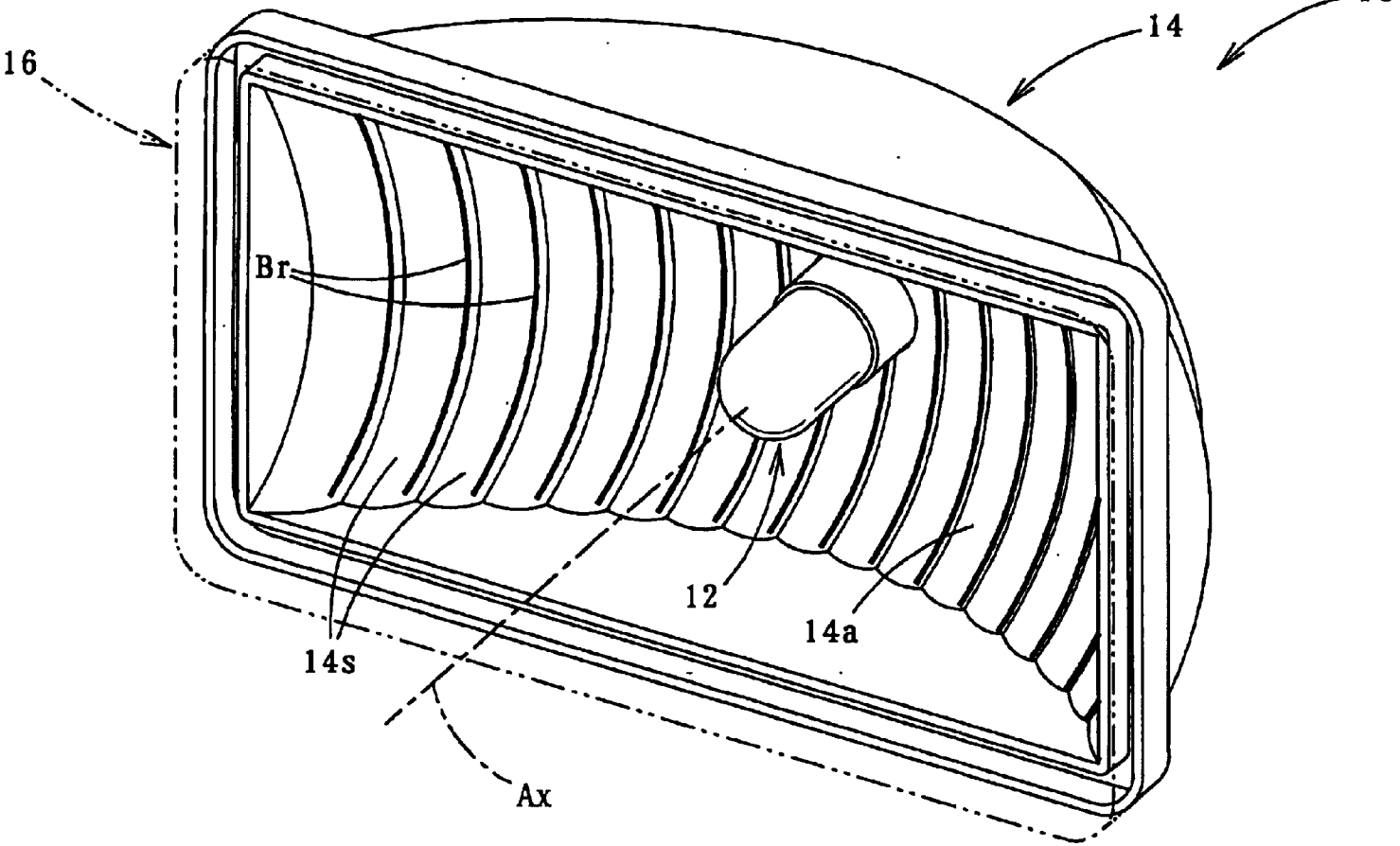
FIG. 5 is a perspective view showing a reflector of the vehicular signal lamp according to the first embodiment.

In an area where the light viewing angles βL and βR are 30 degrees or less, the entire reflecting surface 14*a* appears bright, as shown in FIG. 4, because the reflected light from all reflecting elements 14*s* (of course excluding those reflecting elements masked by a side wall of the reflector 14 or the like) reaches the viewing position. As shown in FIG. 5, black band portions Br extending in vertical stripes in the area in the vicinity of the right end portion of respective reflecting elements 14*s* corresponds to the bright portion of the reflecting element 14*s*.

Thus, according to this embodiment, it is possible to obtain a good appearance for the lamp, even when the lamp is observed from a lateral direction, moving the viewing position to the right or left from the light front direction.

In this embodiment, the reflected light directed at the left direction maximum diffusion angle θL and the light directed at the right direction maximum diffusion angle θR from the respective reflecting elements 14*s* respectively converge at the left side critical viewing position EcL and the right side critical viewing position EcR, which are set to positions 3 m in front of the lamp (3 m behind the vehicle), with the distance of 3 m being a distance where the vehicular signal lamp is observed most carefully by drivers of following vehicles, passing vehicles, or the like. Therefore, the entire reflecting surface 14*a* appears bright until the light viewing angles βL and βR exceed about 30 degrees under actual vehicle operating conditions.

Moreover, as the left side critical viewing position EcL and the right side critical viewing position EcR are set at positions where the light viewing angles βL and βR are 30 degrees, the right and left direction diffusion angles required for the signal lamp 10 to function properly as a tail lamp can be sufficiently attained.

It is sufficient for the light distribution function of a tail lamp to have light viewing angles βL and βR as in this embodiment. However, if the light viewing angle exceeds 30 degrees, the lamp does not necessarily appear dark because irradiation light is obtained directly from the light source bulb 12.

Next, a modification of the first embodiment will be described.

Figure 6:
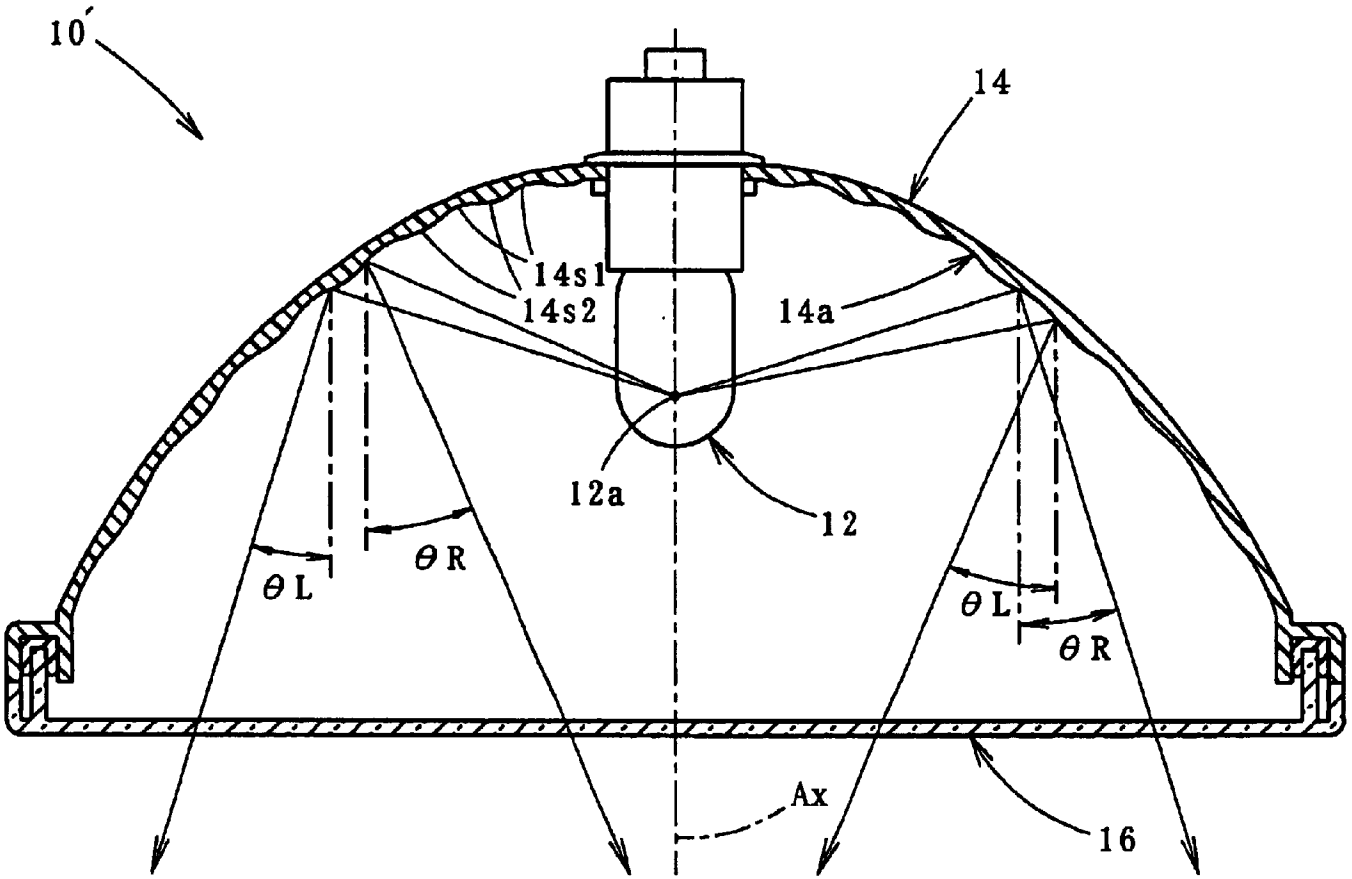
FIG. 6 is a view similar to FIG. 2 showing a modification of the first embodiment.
Figure 7:
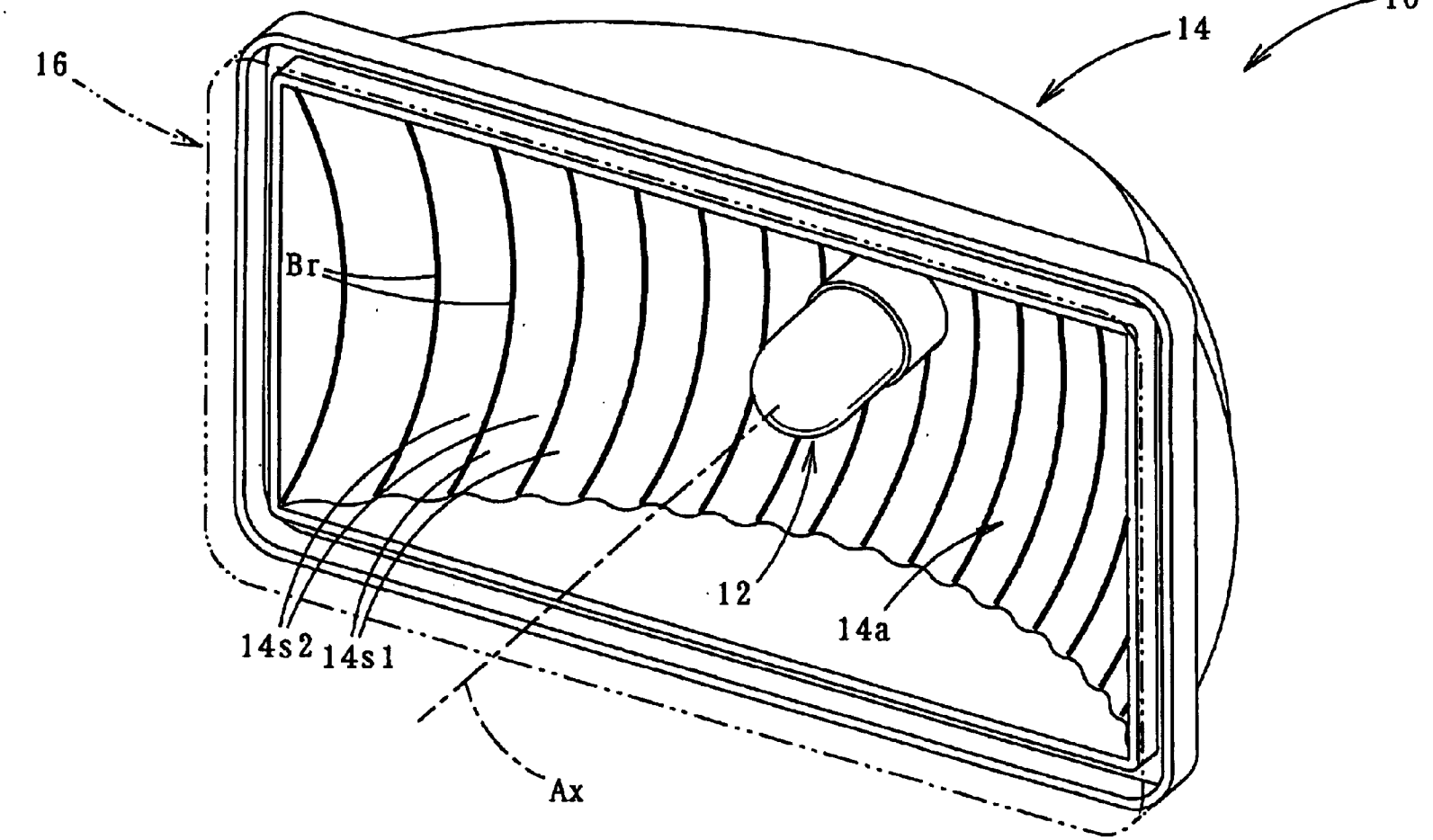
FIG. 7 is a view similar to FIG. 5 showing the modification of FIG. 6.

FIGS. 6 and 7 are views similar to FIGS. 2 and 5 showing a vehicular signal lamp according to the modification.

As shown in FIG. 6, a vehicular signal lamp 10' according to the modification is similar to the first embodiment in its basic composition. However, the modification is different from the first embodiment in that a plurality of reflecting elements composing the reflecting surface 14*a* of the reflector 14 are formed by arranging reflecting elements 14*s*1 which are concave in horizontal section and reflecting elements 14*s*2 which are convex in horizontal section alternatingly in right and left directions.

As shown in FIG. 7, the modification is different from the first embodiment in that a bright portion Br appears at the connection portion between the left end portion of the reflecting elements 14*s*1 and the right end portion of the reflecting elements 14*s*2 when the lamp is observed in a lateral direction, but is similar to the first embodiment in that the entire reflecting surface 14*a* appears bright until the light viewing angle exceeds about 30 degrees.

When the plurality of reflecting elements 14*s* are constructed by arranging the plurality of reflecting elements 14*s* so that concave horizontal section reflecting elements 14*s*1 and convex horizontal section reflecting elements 14*s*2 alternate with one another in right and left directions, the reflecting surface can be formed without creating graduations or ridge lines, thereby further improving the appearance of the lamp.

Next, a second embodiment of the invention will be described.

Figure 8:
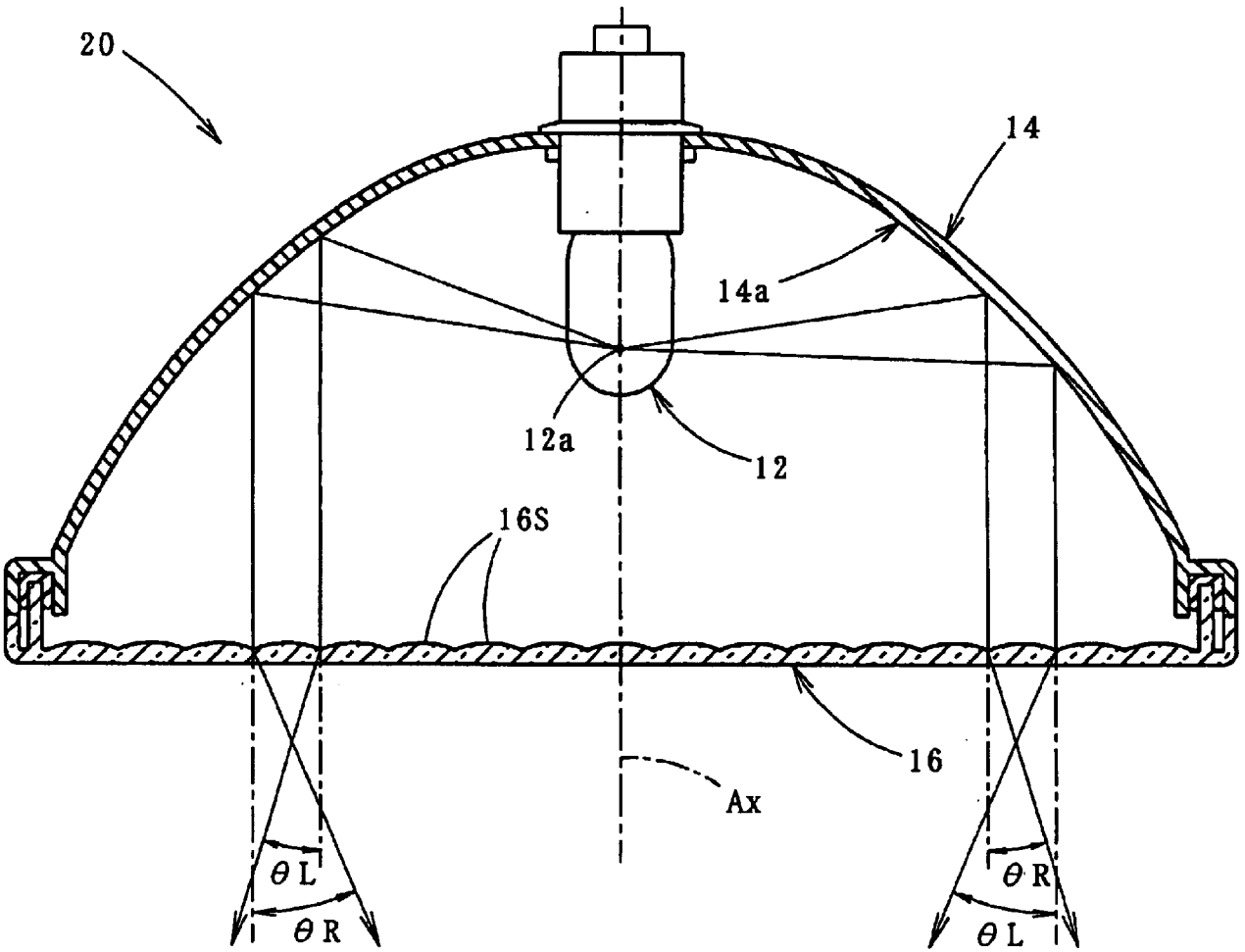
FIG. 8 is a cross-sectional view showing a vehicular signal lamp constructed according to a second embodiment of the invention.
Figures 9A, 9B:
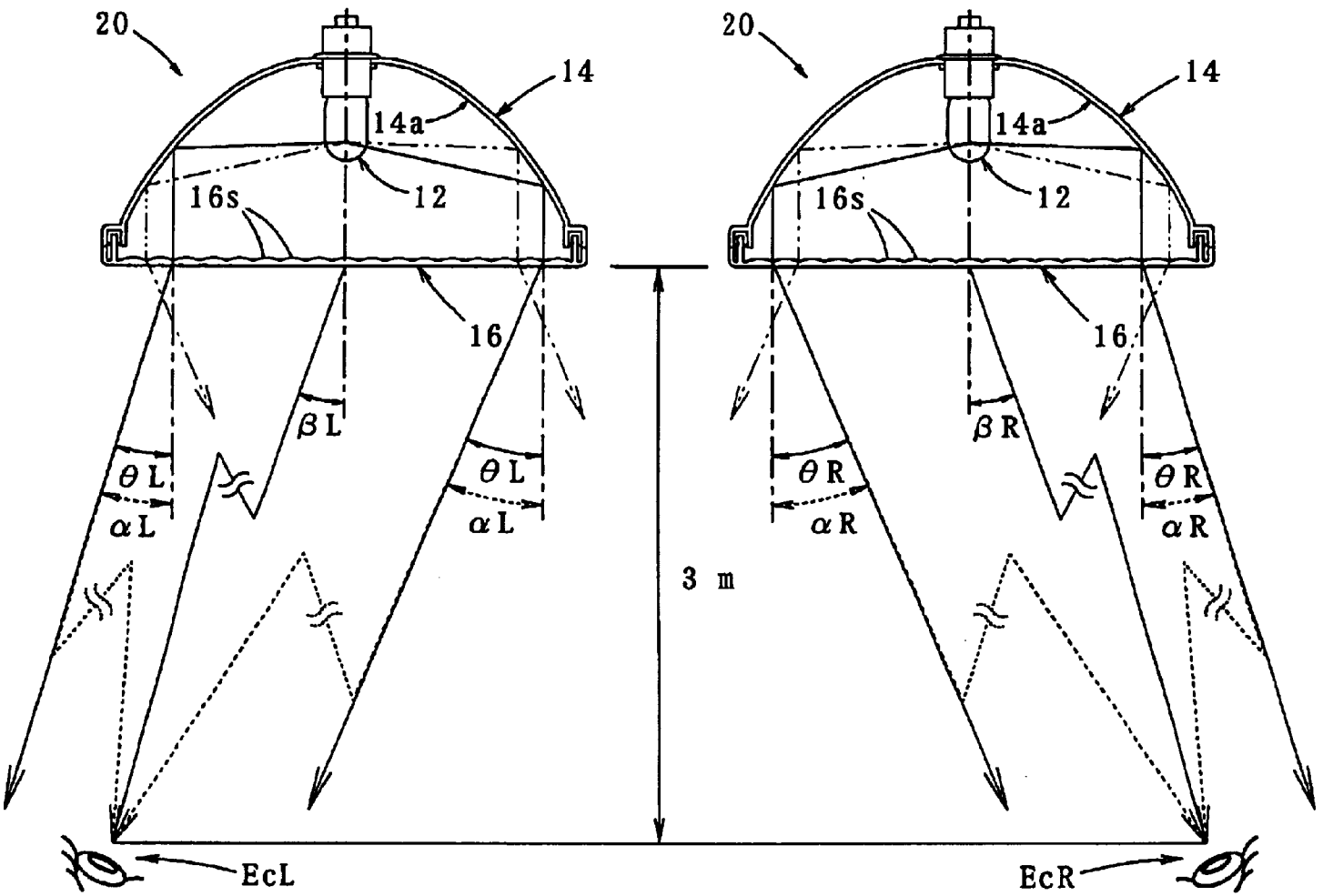
FIGS. 9A and 9B are cross-sectional views illustrating the operation of the vehicular signal lamp according to the second embodiment.

FIGS. 8, 9A and 9B are views similar to those of FIGS. 2, 3A and 3B, respectively, showing a vehicular signal lamp constructed according to the second embodiment.

As shown in FIG. 8, a vehicular signal lamp 20 according to this embodiment is similar to the first embodiment in its basic composition, but differs from the first embodiment in the composition of the reflecting surface 14*a* of the reflector 14 and the front lens 16.

More specifically, in the signal lamp 20 of the second embodiment the reflecting surface 14*a* of the reflector 14 is composed of a parabolic surface having as central axis the optical axis Ax of the reflector 14 and as focal point the filament 12*a* position on the optical axis Ax so as to reflect the light from the light source bulb 12 as a substantially parallel light beam. A plurality of lens elements 16*s* are formed in the front lens 16, divided into vertical stripes, for diffusing and transmitting the reflected light from the reflecting surface 14*a*.

The lens elements 16*s* are formed as cylindrical lens elements convex in horizontal section. Consequently, the light from the lens elements 16*s* become maximum in the right direction diffusion angle at the left end portion of the lens elements 16*s*, and the left direction diffusion angle becomes maximum at the right end portion of the lens elements 16*s*.

In this embodiment, the left direction maximum diffusion angle θL of the respective lens elements 16*s* is set to a smaller value the nearer the lens element is located to the left end portion of the front lens 16, and the right direction maximum diffusion angle θR of the respective lens elements 16*s* is set to a smaller value the nearer the lens element is located to the right end portion of the front lens 16.

More specifically, the horizontal tangential angle of the lens element 16*s* at both the right and left end portions of the respective lens elements 16*s* is calculated so that the reflected light directed at the left direction maximum diffusion angle θL from the lens elements 16*s* converges at the left side critical viewing position EcL as shown in FIG. 9A, and the light directed at the right direction maximum diffusion angle θR from the respective lens elements 16*s* converges at the right side critical viewing position EcR as shown in FIG. 9B. The horizontal sectional shape of the respective lens elements 16*s* is determined based on the results of such calculations.

The left side critical viewing position EcL and right side critical viewing position EcR are set to positions where the light viewing angles βL and βR are 30 degrees at a viewing position 3 m in front of the lamp (3 m rearward the vehicle).

As shown in FIGS. 9A and 9B, every left direction maximum diffusion angle θL of the transmitted light from the respective lens elements 16*s* agrees with an element viewing angle αL of the lens elements 16*s*, and every right direction maximum diffusion angle θR of the transmitted light from the respective lens elements 16*s* agrees with an element viewing angle αR of the lens elements 16*s*. Therefore, when the lamp is observed from a lateral direction, the front lens 16 appears as follows.

Figure 10:
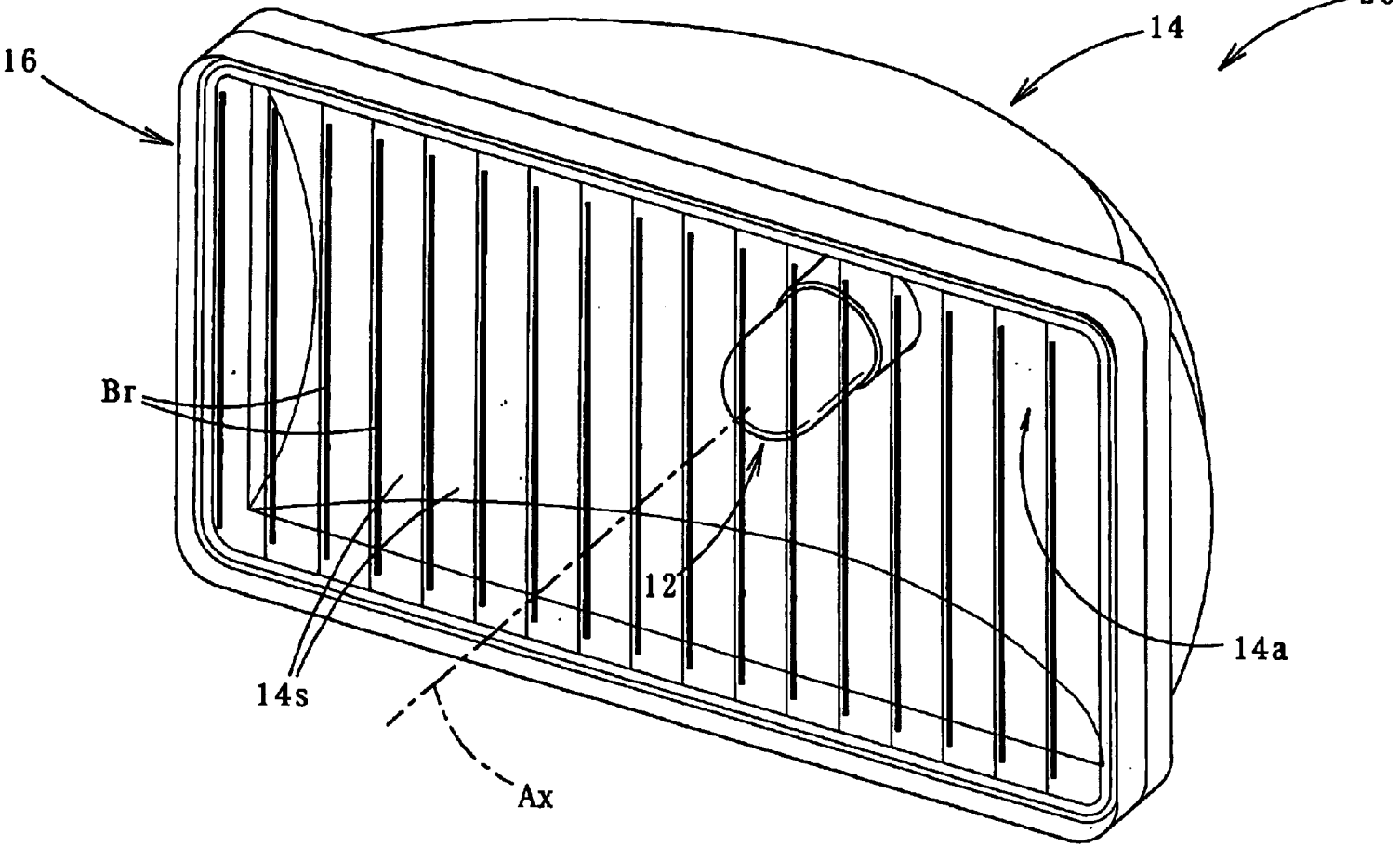
FIG. 10 is a perspective view showing the front lens of the vehicular signal lamp according to the second embodiment.

In an area where the light viewing angles βL and βR are 30 degrees or less, the entire front lens 16 appears bright because the transmitted light from all lens elements 16*s* reaches the viewing position. In FIG. 10, black band portions Br extending as vertical stripes in the vicinity of the left end portion of respective lens element 16*s* corresponds to the bright portion of the lens element 16*s*.

Thus, this embodiment provide a good appearance for the lamp, even when the lamp is observed from a lateral direction.

In this embodiment, the transmitted light directed at the left direction maximum diffusion angle θL and the light directed at the right direction maximum diffusion angle θR from the respective lens elements 16*s* converge at the left side critical viewing position EcL and the right side critical viewing position EcR at positions 3 m in front of the lamp. Thus, this embodiment achieves the same advantageous effects as in the first embodiment.

Next, a third embodiment of the invention will be described.

Figure 11:
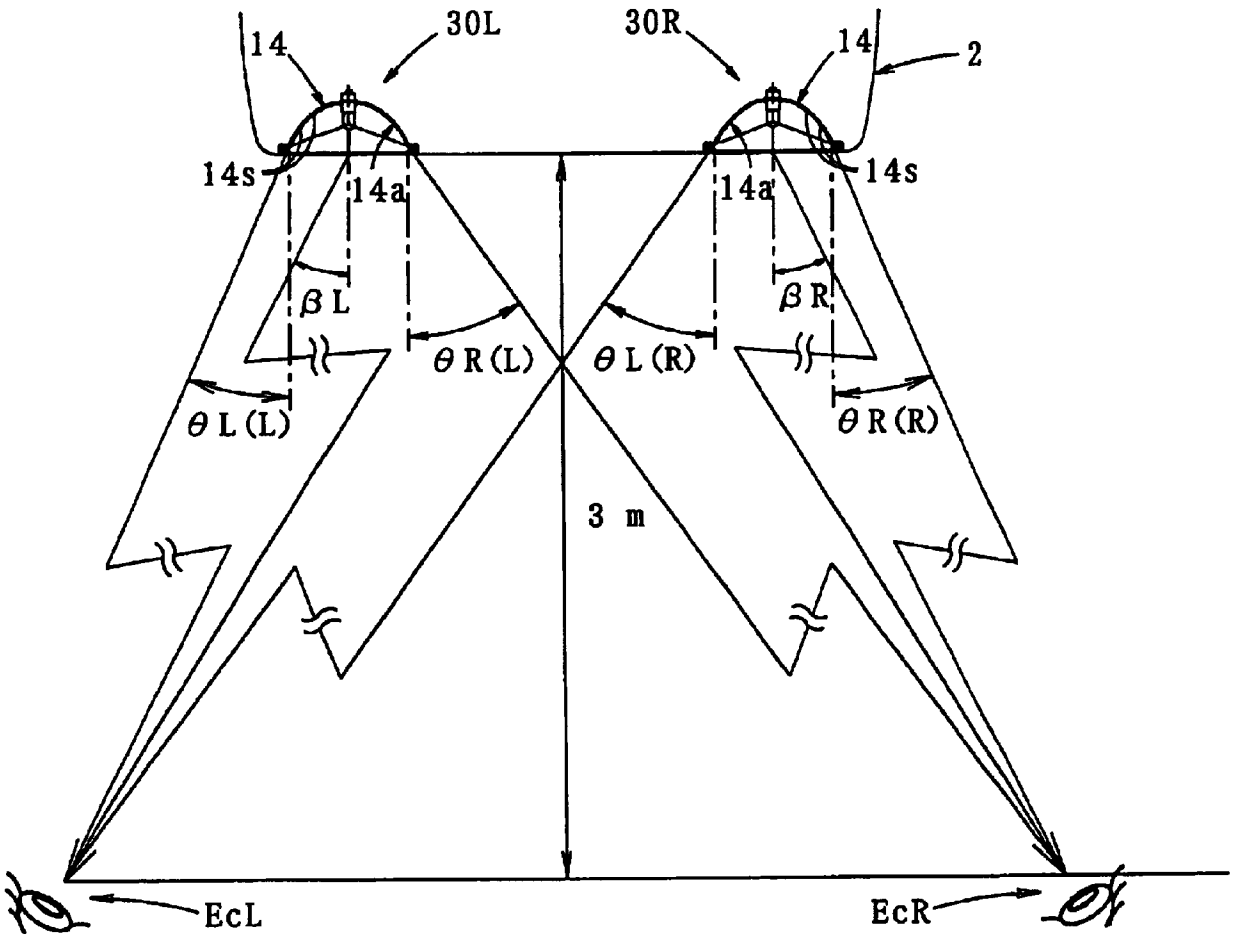
FIG. 11 is a cross-sectional view showing a vehicular signal lamp constructed according to a third embodiment of the invention.
Figure 12B:
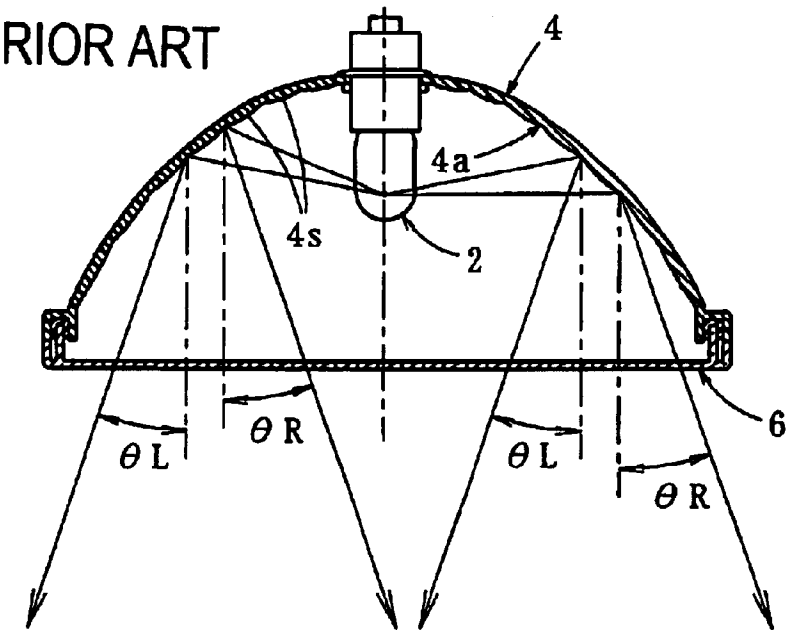
FIG. 12B PRIOR ART
FIGS. 12A and 12B are views similar to FIG. 2 showing an example of a conventional vehicular signal lamp.
Figure 12A:
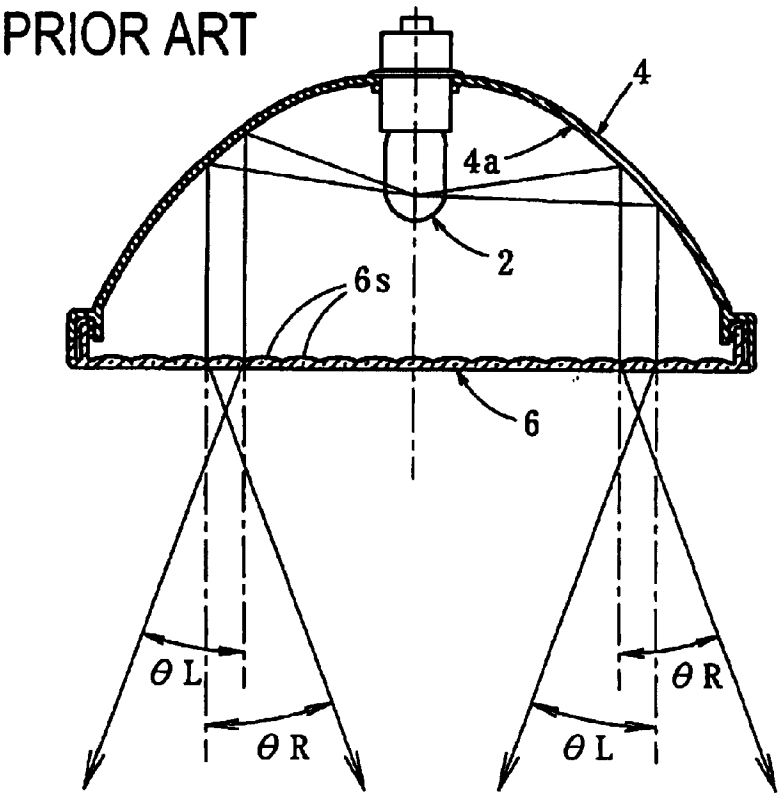
FIG. 12A PRIOR ART
Figure 13:
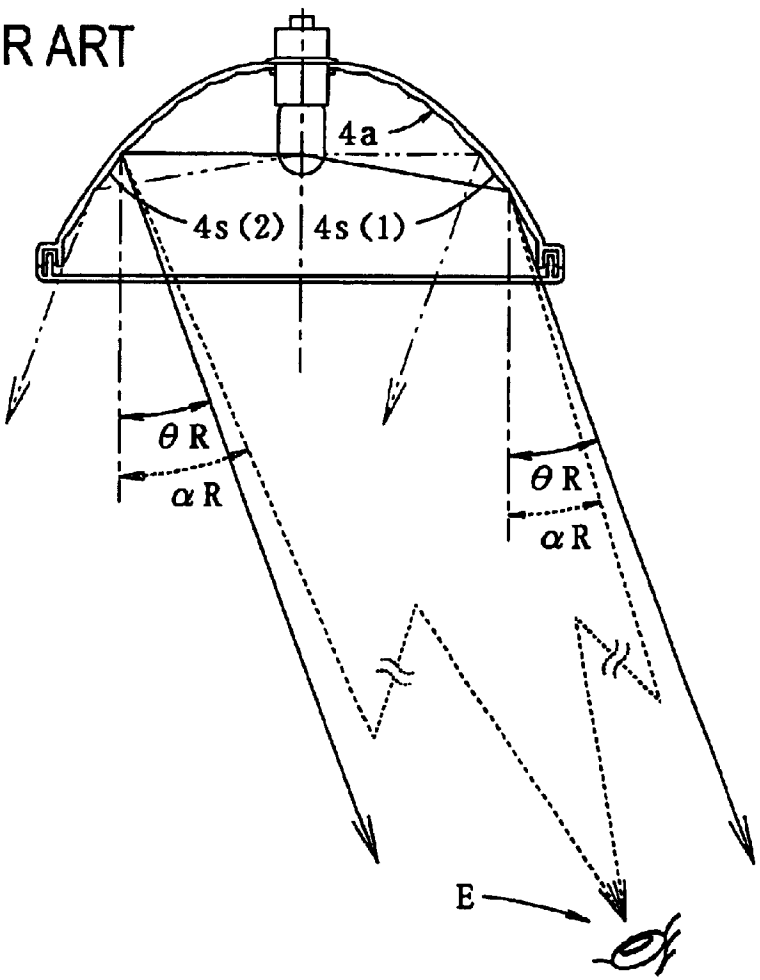
FIG. 13 PRIOR ART
FIG. 13 is a view similar to FIGS. 3A and 3B showing an example of a conventional vehicular signal lamp.
Figure 14:
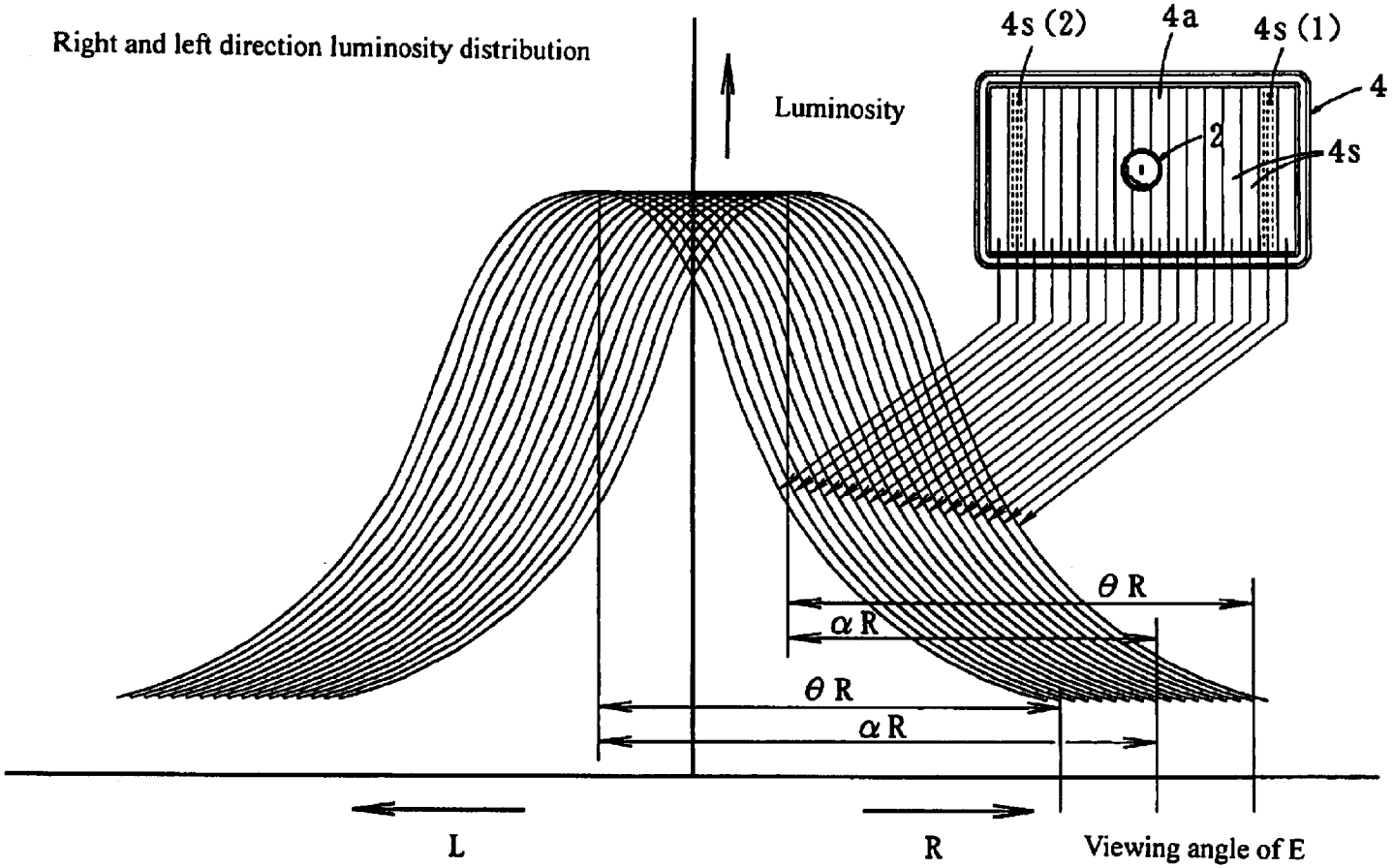
FIG. 14 PRIOR ART
FIG. 14 is a view similar to FIG. 4 showing an example of a conventional vehicular signal lamp.
Figure 15:
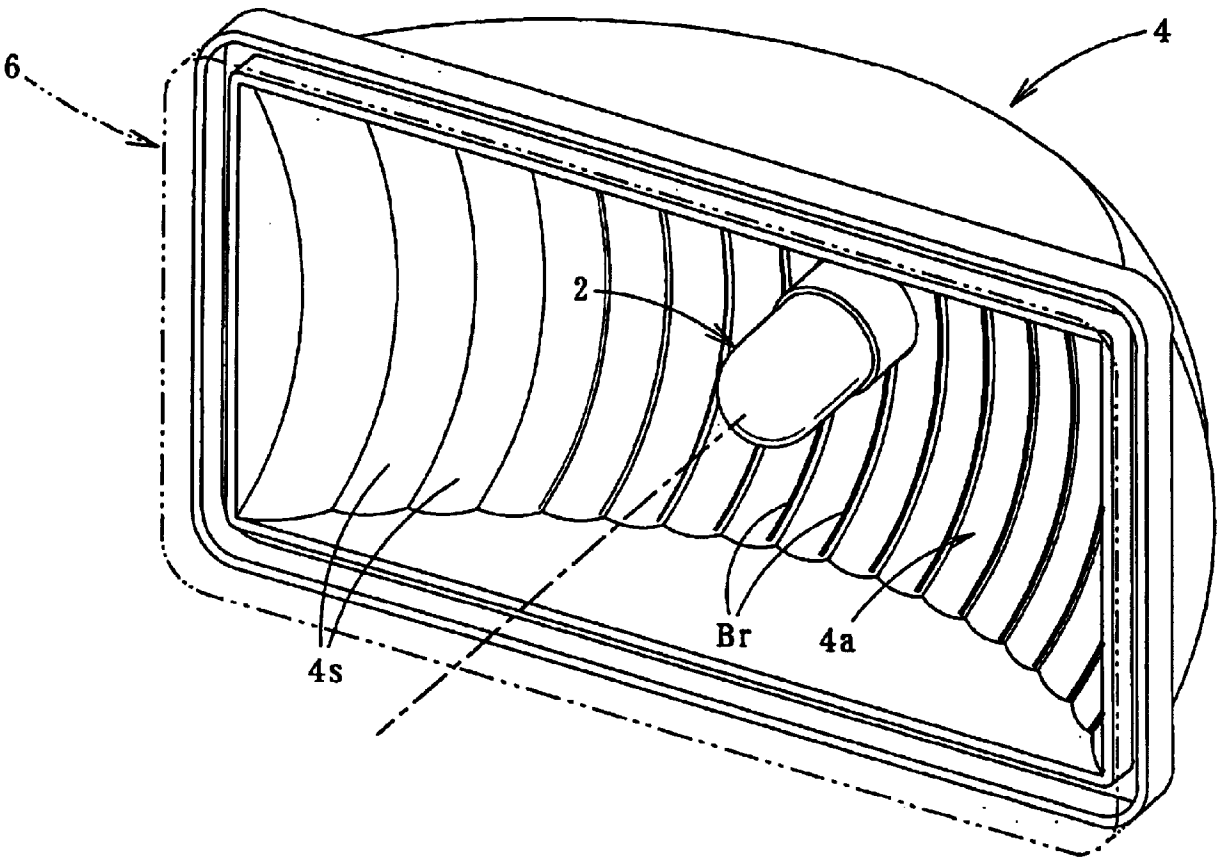
FIG. 15 PRIOR ART
FIG. 15 is a view similar to FIG. 5 showing an example of a conventional vehicular signal lamp.

FIG. 11 is a cross-sectional view showing a vehicular signal lamp constructed according to the third embodiment.

As shown in FIG. 11, a pair of signal lamps 30L and 30R are mounted at the rear end portion of the vehicle with a predetermined interval therebetween in the right and left direction. The composition of the respective signal lamps 30L and 30R is similar to the first embodiment. However, this embodiment differs from the first embodiment in the composition of the reflecting surface 14*a* of the reflector 14 of the lamps 30L and 30R.

More specifically, the left direction maximum diffusion angle θL(L) of the reflected light from the respective reflecting elements 14*s* in the left side lamp 30L is set to a value smaller than the right direction maximum diffusion angle θR(R) of the reflected light from the respective reflecting elements 14*s* of the right side lamp 30R, while the right direction maximum diffusion angle θR(R) of the reflected light from the respective reflecting elements 14*s* of the right side lamp 30R is set to a value smaller than the right direction maximum diffusion angle θL(L) of the reflected light from the respective reflecting elements 14*s* of the left side lamp 30L.

In this embodiment, the left side critical viewing position EcL is set to a position where the light viewing angle θL of the left lamp 30L is 30 degrees at a position 3 m in front of the lamp, and the right side critical viewing position EcR is set to a position where the light viewing angle θR of the right lamp 30R is 30 degrees at a position of 3 m in front of the lamp.

Thus, this embodiment allows the appearance of the two lamps 30L and 30R to be harmonized in the case when a pair of right and left signal lamps 30L and 30R are observed while moving the viewing position in the right and left directions.

Particularly, in this embodiment, as the left side critical viewing position EcL and the right side critical viewing position EcR are set to the same position for both lamps 30L and 30R, the entire reflecting surfaces 14*a* of the two lamps 30L and 30R can be made to appear bright until the light viewing angle AL of the left lamp 30L and light viewing angle βR of the right lamp 30R exceeds 30 degrees.

As the left side critical viewing position EcL and the right side critical viewing position EcR are set to a position 3 m in front of the lamp (3 m behind the vehicle) where the signal lamp 10 is most carefully observed by drivers of following vehicles, passing vehicles, or the like, the entire reflecting surface 14*a* of the two lamps 30L and 30R appears bright until the light viewing angles βL and βR exceed 30 degrees under actual vehicle operating conditions.

Moreover, as the left side critical viewing position EcL and the right side critical viewing position EcR are set to a position where the light viewing angle βL of the left lamp 30L and the light viewing angle βR of the right lamp 30R are 30 degrees, the right and left direction diffusion angles required for the illuminating function of the signal lamps 30L and 30R as tail lamps can be sufficiently obtained.

The third embodiment can also be implemented by employing an arrangement such as that of the second embodiment wherein reflecting elements for diffusing and transmitting in right and left directions light reflected from reflecting surface of the reflector are formed on the front lens.

It is sufficient for the light distribution function of a tail lamp to have light viewing angles βL and βR as in this embodiment. However, if the light viewing angle exceeds 30 degrees, the lamp does not necessarily appear dark because irradiated light is obtained directly from the light source bulb 12.

The aforementioned embodiments have been discussed with respect to the case where each of the signal lamps 10, 20, 30L, and 30R is a tail lamp. However, the invention is also applicable to other types of lamps.

What is claimed is:

1. A vehicular signal lamp, comprising:

a light source bulb, a reflector for reflecting light from said light source bulb in a forward direction, and a transparent front lens provided at a forward side of said reflector, a reflecting surface of said reflector comprising a plurality of reflecting elements for diffusing and reflecting in right and left directions light from said light source bulb, each of said reflecting elements being constructed such that a maximum diffusion angle to at least one side in right and left directions of reflected light from said reflecting element is smaller the nearer said reflecting element is located to an end portion on said one side in said reflecting surface, wherein a horizontal tangential angle of each of said reflecting elements at both right and left end portions of said reflecting elements is determined so that reflected light directed at a left direction maximum diffusion angle from said reflecting elements converges to a left side critical viewing position, and reflected light directed at a right direction maximum diffusion angle from said reflecting elements converges to a right side critical viewing position.

2. The vehicular signal lamp according to claim 1, wherein said plurality of reflecting elements comprise respective concave horizontal section reflecting elements and convex horizontal section reflecting elements arranged alternatingly in right and left directions.

3. The vehicular signal lamp according to claim 1, wherein said reflecting elements are constructed such that light reflected from said reflecting elements in said maximum diffusion angle direction substantially converges at a position 3 to 5 m forward of said lamp.

4. The vehicular signal lamp according to claim 3, wherein said maximum diffusion angle is in a range of 20 to 40 degrees.

5. The vehicular lamp according to claim 1, wherein said left side critical viewing position and said right side critical viewing position are at positions where respective left and right viewing angles with respect to an optical axis of said lamp from right and left lateral directions is approximately 30 degrees at a position approximately 3 m in front of said lamp.

6. A vehicular signal lamp, comprising: a light source bulb, a reflector for reflecting light from said light source bulb in a forward direction, and a transparent front lens provided at a forward side of said reflector, a reflecting surface of reflector being constructed to reflect light from said light source bulb as a substantially parallel light beam, and a plurality of lens elements for diffusing and transmitting in right and left directions light reflected from said reflecting surface being formed on said front lens, each of said lens elements being constructed such that a maximum diffusion angle to at least one side in right and left directions of the transmitted light from said lens element is smaller the nearer the lens element is located to an end portion of said one side in said front lens.

7. The vehicular signal lamp according to claim 6, wherein said plurality of lens elements comprise respective concave horizontal section lens elements and convex horizontal section lens elements arranged alternatingly in right and left directions.

8. The vehicular signal lamp according to claim 6, wherein said lens elements are constructed such that light transmitted from said lens elements in a maximum diffusion angle direction substantially converges at a position 3 to 5 m forward of said lamp.

9. The vehicular signal lamp according to claim 8, wherein said maximum diffusion angle is in a range of 20 to 40 degrees.

10. The vehicular signal lamp according to claim 6, wherein a horizontal tangential angle of each of said lens elements at both right and left end portions of said lens elements is determined so that transmitted light directed at a left direction maximum diffusion angle from said lens elements converges to a left side critical viewing position, and transmitted light directed at a right direction maximum diffusion angle from said lens elements converges to a right side critical viewing position.

11. The vehicular lamp according to claim 10, wherein said left side critical viewing position and said right side critical viewing position are at positions where respective left and right viewing angles with respect to an optical axis of said lamp from right and left lateral directions is approximately 30 degrees at a position approximately 3 m in front of said lamp.

12. A pair of vehicular signal lamps for mounting on a vehicle in left and right directions with a predetermined interval therebetween, each of said lamps comprising:

a light source bulb, a reflector for reflecting light from said light source bulb in a forward direction, and a transparent front lens provided at a forward side of said reflector, a reflecting surface of said reflector comprising a plurality of reflecting elements for diffusing and reflecting in right and left directions light from said light source bulb, each of said reflecting elements being constructed such that a maximum diffusion angle to at least one side in right and left directions of reflected light from said reflecting element is smaller the nearer said reflecting element is located to an end portion on said one side in said reflecting surface, wherein said maximum diffusion angle toward said one side of the reflected light from said reflecting elements of one of said lamps is smaller than said maximum diffusion angle toward said one side of the reflected light from said reflecting elements of the other of said lamps.

13. A pair of vehicular signal lamps for mounting on a vehicle in left and right directions with a predetermined interval therebetween, each of said lamps comprising: a light source bulb, a reflector for reflecting light from said light source bulb in a forward direction, and a transparent front lens provided at a forward side of said reflector, a reflecting surface of reflector being constructed to reflect light from said light source bulb as a substantially parallel light beam, and a plurality of lens elements for diffusing and transmitting in right and left directions light reflected from said reflecting surface being formed on said front lens, each of said lens elements being constructed such that a maximum diffusion angle to at least one side in right and left directions of the transmitted light from said lens element is smaller the nearer the lens element is located to an end portion of said one side in said front lens, wherein said maximum diffusion angle toward said one side of the reflected light from said reflecting elements of one of said lamps is smaller than said maximum diffusion angle toward said one side of the reflected light from said reflecting elements of the other of said lamps.

14. A vehicular signal lamp, comprising:

a light source bulb, a reflector for reflecting light from said light source bulb in a forward direction, and a transparent front lens provided at a forward side of said reflector, a reflecting surface of said reflector comprising a plurality of reflecting elements for diffusing and reflecting in right and left directions light from said light source bulb, each of said reflecting elements being constructed such that a maximum diffusion angle to at least one side in right and left directions of reflected light from said reflecting element is smaller the nearer said reflecting element is located to an end portion on said one side in said reflecting surface, wherein said reflecting elements are constructed such that light reflected from said reflecting elements in said maximum diffusion angle direction substantially converges at a position 3 to 5 m forward of said lamp.

15. The vehicular signal lamp according to claim 14, wherein said maximum diffusion angle is in a range of 20 to 40 degrees.

* * * * *